United States Patent [19]

Young

[11] Patent Number: 4,620,163

[45] Date of Patent: Oct. 28, 1986

[54] $TE_{10}$ RECTANGULAR TO $TE_{01}$ CIRCULAR WAVEGUIDE MODE LAUNCHER

[75] Inventor: Lock R. Young, Palm Bay, Fla.

[73] Assignee: Harris Corporation, Melbourne, Fla.

[21] Appl. No.: 601,292

[22] Filed: Apr. 17, 1984

[51] Int. Cl.[4] ..... H01P 1/16

[52] U.S. Cl. ..... 333/21 R; 333/34; 333/248

[58] Field of Search ..... 333/21 R, 248, 251, 333/34

[56] References Cited

U.S. PATENT DOCUMENTS 2,946,972 7/1960 Hunt et al. ..... 333/21 R X

FOREIGN PATENT DOCUMENTS 1142642 1/1963 Fed. Rep. of Germany .... 333/21 R 0497666 3/1976 U.S.S.R. ..... 333/21 R

*Primary Examiner*—Eugene R. LaRoche

*Assistant Examiner*—Benny T. Lee

[57] ABSTRACT

The first section of a Marie'-configured $TE_{10}$ rectangular mode to $TE_{01}$ circular mode waveguide launcher is modified to provide an effectively true linear taper for the injected $TE_{10}$ mode wave to the emitted $TE_{20}$ mode wave. As a result, the first section is well matched at the low end of the frequency band as well as being resonance free to frequencies above the upper end of the band of interest. According to this modification, rather than have a single taper for the triangular shaped lower portion of the first section, the lower triangular portion has a second taper extending from the intersection at the lower wall of the input to the height of the exit wall at the output. This second taper provides an effective true linear taper for the input section. Thus, not only is there improved performance, in terms of electrical impedance matching and resonance free operation, but the input section is easier to machine, since there is no requirement of the insertion of formation of an internal impedance matching element.

11 Claims, 15 Drawing Figures

$TE_{10}$ RECTANGULAR TO $TE_{01}$ CIRCULAR WAVEGUIDE MODE LAUNCHER

FIELD OF THE INVENTION

The present invention is directed to an electromagnetic energy wave launcher and is particularly directed to an improved input or front end section of a $TE_{10}$ rectangular to $TE_{01}$ circular waveguide mode launcher containing a $TE_{20}$ rectangular mode conversion section coupled between a $TE_{10}$ rectangular input section and the $TE_{01}$ circular output section.

BACKGROUND OF THE INVENTION

The fundamental configuration of a $TE_{10}$ rectangular to $TE_{01}$ circular waveguide mode launcher as developed by P. Marie' in 1956 is shown perspectively in FIG. 1 as containing three series-coupled sections A, B and C. The first or input section A is shown in perspective in FIG. 2, associated side and end views of which are presented in FIGS. 3 and 4, respectively. This first or input section A into which a $TE_{10}$ rectangular mode wave is launched, via a rectangular-shaped input end 11, is formed as a "folded E-plane tee" for converting a $TE_{10}$ rectangular mode wave to a $TE_{20}$ rectangular mode wave to be emitted at rectangular shaped output end 12.

For this purpose, as shown in FIGS. 2–4, the first conversion section A contains a pair of intersecting rectangular tapered portions 13 and 14. The input or front end 11 of a triangular or tapered portion 13 sits atop a triangular or tapered bottom portion 14 and tapers from an original height 13H along the length of the input section A until it coincides with the upper edge 7 of the wave exiting or output rectangular end 12. The upper surface 15 and the lower surface 16 of triangular shaped section 14 are parallel with one another and separated by a distance equal to the height 14H of section 14. At its output end, the first section A has a width 14W, corresponding to the separation between vertical end walls 18 and 19 which together with upper and lower surfaces 15 and 16 of section 14 form the tapered wall boundaries of section 14. The width 13W of tapered top section 13 represents the separation between parallel side walls 8 and 9 of top section 13 which taper from an initial height 13H to the edge 7 of upper surface 15 at output end 12 with a taper angle $\phi$. Side walls 18 and 19 of triangular section 14 form a taper angle $\theta$ between wall portions 18 and 19 of section 14 and the wall portions 8 and 9 of tapered section 13.

Inserted into the central portion of section A is an impedance matching element 17, which acts to remove a high frequency resonance component and helps match the low end of the band of interest. For purposes of an illustrative example, the mode launcher under consideration is intended to operate in a range of 5.5 to 8.5 GHz.

FIGS. 5A, 5B and 5C illustrate the manner in which an input rectangular mode $TE_{10}$ wave is converted to an output rectangular mode $TE_{20}$ wave, as the height of the vertical walls 8 and 9 is gradually decreased, while the separation between walls 18 and 19 gradually increases by way of the dual taper of sections 13 and 14. The arrows represent the direction of the electric field vector in the waveguide.

The second section of the mode launcher is shown in perspective in FIG. 6 and in a pair of cross-sectional views of the middle and output ends of the section in FIGS. 7A and 7B, respectively. The arrows represent the direction of the electric field vector in the waveguide. This middle section B is employed to gradually change the $TE_{20}$ rectangular mode output wave from the first section A which enters the second section B at open end 21 to an "X" configuration at output end 22, as shown particularly in FIG. 7B.

For this purpose, the input end 21 of second section B has a rectangular-shaped opening defined by a pair of parallel top and bottom walls 27 and 28 and parallel side walls 29 and 30 into which the $TE_{20}$ rectangular mode wave from the output of the first section A is coupled. Extending from these walls are four projecting finger portions 23, 24, 25 and 26 forming an "X" cross-sectional shape, each finger portion being a triangular or tapered waveguide section extending from the parallel side walls 29 and 30 at the front end 21 of section B to the output end 22 thereof. This rectangular-to-"X" tapering configuration sets up four orthogonally spaced components of the wave to be aligned with eventual circular waveguide $TE_{01}$ mode of the end section C, shown in greater detail in FIG. 8.

As shown therein, to achieve the final circular waveguide output $TE_{01}$ mode, a set of four tapered sections 43, 44, 45 and 46 having respective input ends 33, 34, 35 and 36 are aligned with the four "X"-shaped waveguide output ends of the sections 23, 24, 25 and 26 of center section B. Each of sections 43–46 tapers to an output circular shape, as shown in perspective in FIG. 8 and in cross-section in FIG. 9, so that what is launched from the output 50 of the section C is a circular $TE_{01}$ mode wave. The circular arrow represents the direction of the electric field vector in the waveguide.

With the sections A, B and C serially interconnected in the manner shown in FIG. 1, the effect of each section is to provide a linear taper from one impedance to the next. If the wavelength distance of each tapered is sufficiently long, each section will be well matched. However, for present day antenna feed operations the Marie' configuration is imperfect. Thus, it has been found necessary to insert an impedance matching element (shown as element 17 in FIGS. 3 and 4) for the purpose of removing the high frequency resonance component and help match the low end of the frequency band of interest. A practical problem that exists in the conventional Marie' configuration is the cost involved in making a precision mandrel to produce the impedance matching element, which is a doubly tapered-wedge shaped piece, and is effectively impossible to machine into a mandrel as would be required. Typically, the mode launcher is electroformed over a mandrel. This means that the impedance matching element could be manufactured separately and later inserted into the section A of the mode launcher. Still, this would be a more expensive procedure than if the impedance matching element could actually be formed as part of the mandrel itself.

SUMMARY OF THE INVENTION

In accordance with the present invention, the poor match capabilities of the basic Marie' folded Tee configuration of the first section and the need to insert an impedance matching element therein are obviated by an improved front end section A which provides an effectively true linear taper for the injected $TE_{10}$ mode wave to the emitted $TE_{20}$ mode wave. This means that the first section is well matched at the low end of the frequency band as well as being resonance free to frequencies above the upper end of the band of interest (for example the above-referenced 5.5 to 8.5 GHz band).

Pursuant to the present invention, rather than have a single taper for the lower section 14, which single taper is prescribed by the angle $\theta$ as shown in FIG. 2, the lower section has a second taper $\Psi$ extending from the intersection at the lower wall of the input to the height of the exit wall at the output. This second taper provides an effective true linear taper, as noted above, for the input section A. Thus, not only is there improved performance, in terms of electrical impedance matching and resonance free operation, but the input section is easier to machine, since there is no requirement of the insertion or formation of an internal doubly tapered impedance matching element. In the conventional Marie' design, the parallel top and bottom walls of the lower triangular shaped portion contribute to the establishment of a trapped resonance mode at the upper end of the frequency band. In accordance with the double taper configuration of the present invention, this resonance is never allowed to be generated. Moreover, the impedance transition is much smoother, so that there is no spike transition and minimum returns loss.

DETAILED DESCRIPTION

Figure 12:
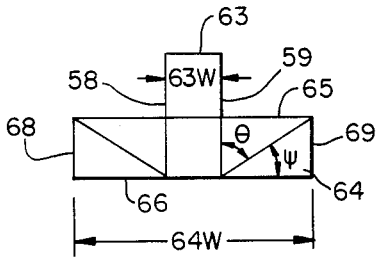
FIG. 12 is an end view of the improved mode launcher front end section A according to the present invention.
Figure 11:
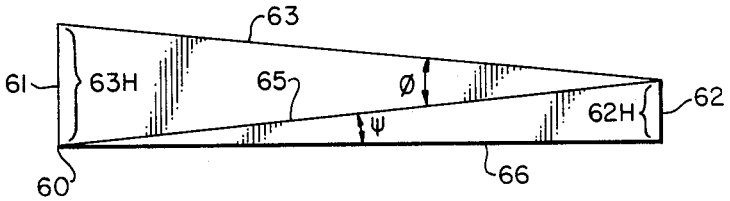
FIG. 11 is a side view of the improved front end section A of the mode launcher according to the present invention.
Figure 10:
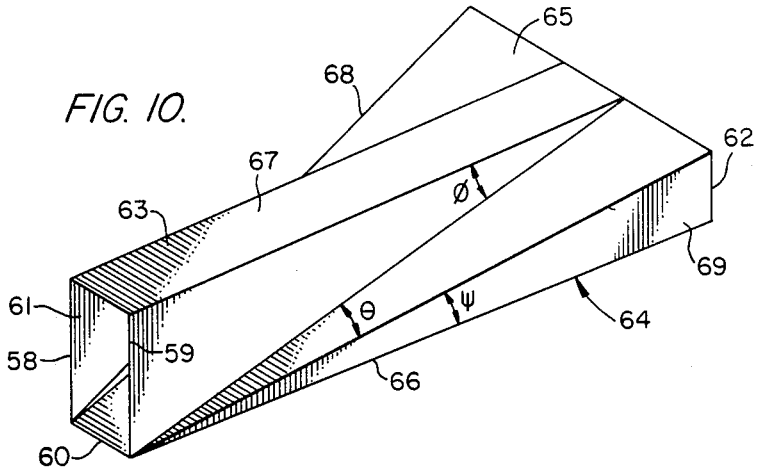
FIG. 10 is perspective view of the improved front end section A of a Marie' type mode launcher in accordance with the present invention.

Referring now to FIGS. 10, 11 and 12, there are shown respective perspective, side and end views of the improved front end section A of a Marie' type $TE_{10}$ rectangular to $TE_{01}$ circular waveguide mode launcher according to the present invention.

Figure 1:
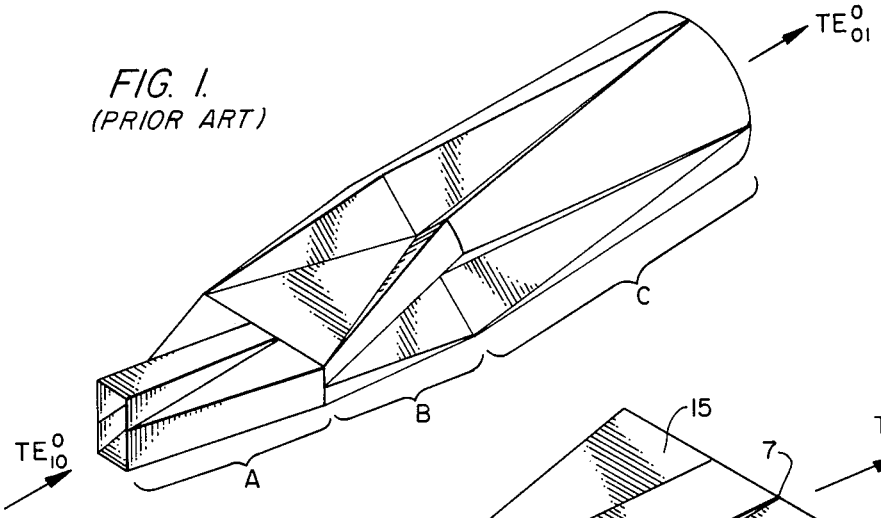
FIG. 1. (PRIOR ART)
FIG. 1 is an illustration of a conventional Marie' multi-section $TE_{10}$ rectangular to $TE_{01}$ circular waveguide mode electromagnetic-wave launcher.
Figure 2:
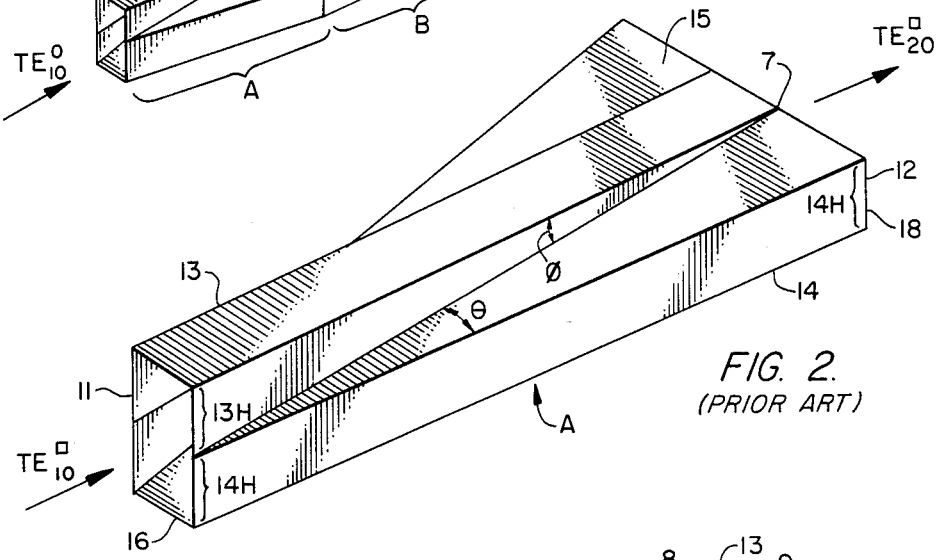
FIG. 2. (PRIOR ART)
FIG. 2 is a pictorial illustration of the input section A mode launcher shown in FIG. 1.
Figure 4:
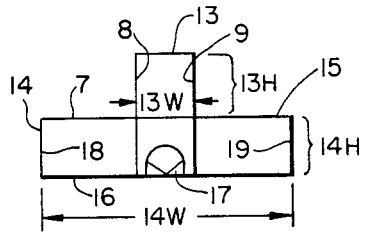
FIG. 4. (PRIOR ART)
FIGS. 3 and 4 are respective side and end views of the mode launcher section shown in FIG. 2.
Figure 3:
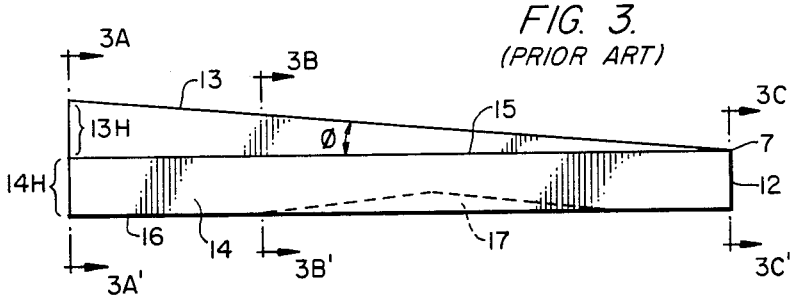
FIG. 3. (PRIOR ART)
Figure 5A:
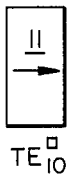
FIG. 5A. (PRIOR ART)
FIGS. 5A, 5B and 5C are end sectional views taken along lines 3A—3A', 3B—3B' and 3C—3C' of FIG. 3.
Figure 5B:
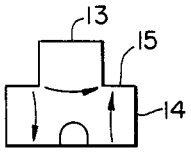
FIG. 5B. (PRIOR ART)
Figure 5C:
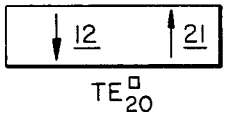
FIG. 5C. (PRIOR ART)
Figure 7A:
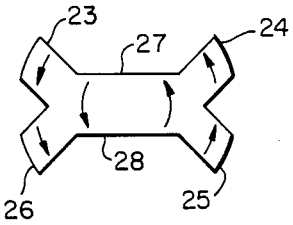
FIG. 7A. (PRIOR ART)
FIGS. 7A and 7B are end sectional views of the interior of the central section B of the mode launcher shown in FIG. 1 taken along lines 6A—6A' and 6B—6B' of FIG. 6.
Figure 7B:
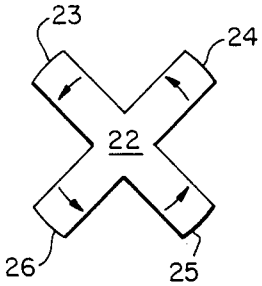
FIG. 7B. (PRIOR ART)
Figure 9:
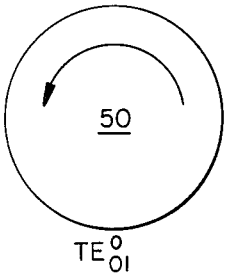
FIG. 9. (PRIOR ART)
FIG. 9 is an end view of the output end of the mode launcher section C shown in FIG. 8 in the direction of launch transmission of the $TE_{01}$ wave.
Figure 6:
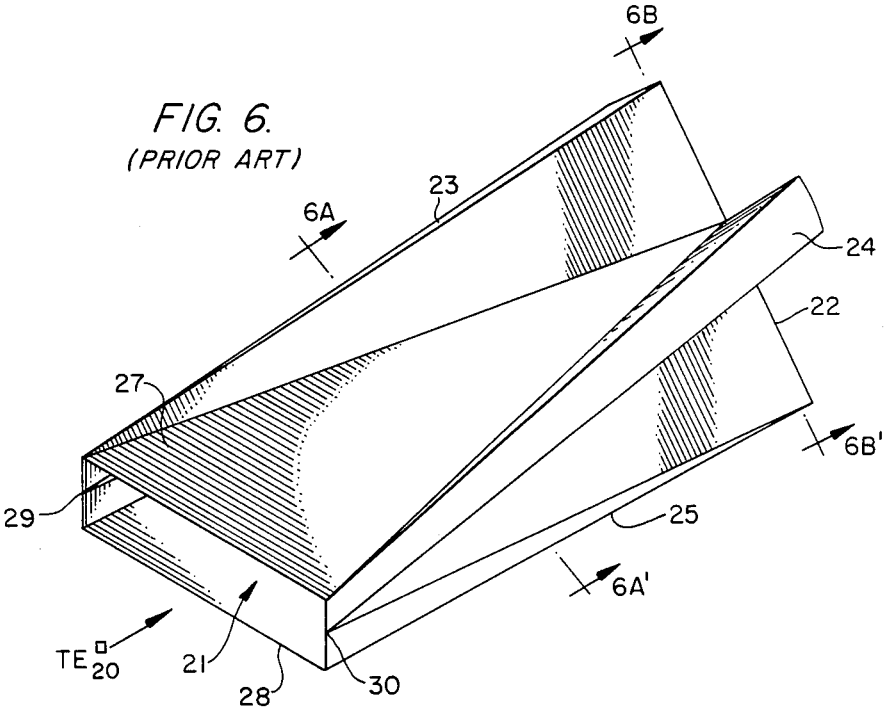
FIG. 6. (PRIOR ART)
FIG. 6 is a perspective view of the second section B of the mode launcher shown in FIG. 1.
Figure 8:
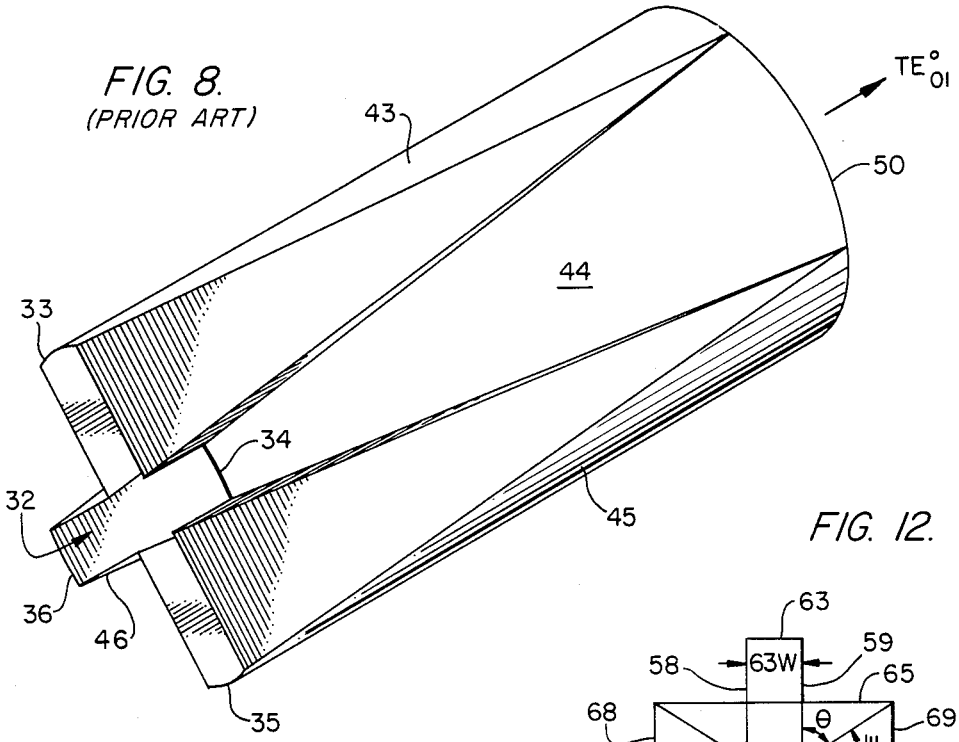
FIG. 8. (PRIOR ART)
FIG. 8 is a perspective view of the third section C of the mode launcher shown in FIG. 1.

As can be seen from a comparison of FIGS. 10, 11 and 12 with FIGS. 2, 3 and 4, the front end section of the mode launcher of the present invention differs from that of a conventional Marie' type launcher in that the upper and lower surfaces, here 65 and 66 of the section 64, rather than being parallel with one another from the input end 61 of the launcher to the output end 62 thereof, are tapered from the output end 62 to the lower front edge 60 at the bottom wall 66 of the input end 61 so as to form an acute angle $\Psi$ therebetween. Thus there is effectively created a dual taper between the top wall 67 of the input tapered section 63 and the top wall 65 of the lower tapered section 64. Input end 61 of the mode launcher of the present invention shown in FIGS. 10–12 corresponds to the open rectangular input end 11 of the conventional mode launcher front end section shown in FIGS. 2–4. Similarly, output rectangular open end section 62 of the embodiment of the invention shown in FIGS. 10–12 corresponds to the output open rectangular end 12 of the front end section shown in FIGS. 2–4. At the opposite ends of the front end section, each of walls 68 and 69 of bottom tapered section 64 and walls 58 and 59 of the input tapered section 63 are parallel with one another and spaced apart by the respective widths of the rectangular ends formed by the intersecting orthogonal walls thereat. Similarly, the height 63H of the open end into which the $TE_{10}$ rectangular mode wave is injected is the same as the overall height 13H+14H of input section 11 of the conventional mode launcher shown in FIGS. 2–4. The same holds true for the height 62H of the output opened rectangular end 62, which corresponds to the height 14H of output open end 12 of the front end section shown in FIGS. 2–4. Thus, the difference between the improved configuration of the present invention and that of a conventional Marie' launcher is the tapering of the upper wall 65 towards the lower front edge 60 of the input end 61 creating the acute angle $\Psi$ between upper wall 65 and lower wall 66. This reduction in guide height due to the taper $\Psi$ significantly improves the operation of the present invention over a conventional Marie' type design.

More specifically, in the conventional Marie' configuration, the rectangular $TE_{10}$ mode wave converts to a $TE_{20}$ mode wave up until the point that the crossed $TE_{10}$ is above cutoff. Thereafter, the energy is split between the two modes. As the $TE_{10}$ mode wave proceeds down the input section A, it reaches cutoff just prior to the end of the input section and is reflected back. This reflected energy does not completely convert back to the input $TE_{10}$ mode and is therefore trapped in the input section A, causing a resonance to be set up when it is matched to the input energy. In accordance with the invention, by providing the taper between the upper and lower walls 65 and 66 of the mode launcher shown in FIGS. 10–12, without the need for the insertion of an impedance matching element, the above-referenced resonance phenomenon cannot occur. In the frequency range of interest, the present invention operates with a return loss of at least 30 dB.

With the true dual linear taper provided by the present invention, the front end section A of the mode launcher is well matched at the low end of the frequency band and, of course, as mentioned above, is resonance free at the upper end of the band. Thus, the present invention is capable of providing a substantial improvement over a conventional Marie' design and even one in which an impedance matching element such as the dual tapered insertable component shown in FIGS. 3 and 4 is employed. This means that the manufacturing process may be considerably simplified and the desired electrical properties of the device are achieved.

In terms of its physical configuration, for a frequency range of 5.5–8.5 GHz, the degree of taper is over a waveguide length of approximately two guide wavelengths minimum, so that at a frequency of about 6 GHz, the distance from the end to the rear of the section 6A is about 6 inches.

With respect to the tapering of top wall 65 toward bottom wall 66 and the tapering of side walls 68 and 69 toward each other, the illustration in FIGS. 10, 11 and 12 show substantially continuously linear (e.g. triangular) tapers for the sake of simplicity. It should be observed, however, that the precise degree of the taper need not be continuously linear, but may be curved, stepwise linear, etc. as long as the taper employed effectively inhibits the above mentioned resonance problem and provides the intended matching properties.

While I have shown and described an embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed:

1. For use in an electromagnetic wave launcher, a device for converting a $TE_{10}$ rectangular made wave to a $TE_{20}$ rectangular mode wave comprising:

a first open-ended wedge-shaped waveguide section having an open input end of rectangular cross-section to which a $TE_{10}$ rectangular mode wave is to be applied, and tapering to a vertex at an open output end of said device; and a second open-ended wedge-shaped waveguide section having an open output end of rectangular cross-section from which a $TE_{20}$ rectangular mode wave is to be output, and tapering to a vertex at an open input end of said device; and wherein said first section is integrally coupled with said second section so that the vertex of said first section at the open output end of said device forms part of an edge of the rectangular cross-section output end of said second section and the vertex of said second section at the open input end of said device forms part of an edge of the rectangular cross-section input end of said first section.

2. A device according to claim 1, wherein said second section is formed of top and bottom wall portions and first and second side wall portions which extend from said rectangular cross-section output end of said second section to the input end of said first section, such that said top and bottom wall portions of said second section intersect one another at said input end of said first section, thereby forming the vertex of the taper of said second section thereat.

3. A device according to claim 2, wherein the first and second side wall portions of said second section are vertically-parallel with one another and taper from the rectangular cross-section output end of a said second section to the rectangular cross-section input end of said first section.

4. A device according to claim 2, wherein said first section is formed of a top wall portion and first and second side wall portions which extend from said rectangular cross-section input end of said first section to the output end of said section, such that the top wall portion of said first section intersects the top wall portion of said second section at the output end of said second section, thereby forming the vertex of the taper of said first section thereat.

5. A device according to claim 4, wherein the first and second side wall portions of said first section are parallel with one another and extend from an edge of the rectangular cross-section output end of said second section to the rectangular cross-section input end of said first section.

6. A device according to claim 5, wherein the first and second side wall portions of said second section are vertically-parallel with one another and taper from the rectangular cross-section output end of a said second section to the rectangular cross-section input end of said first section.

7. A device according to claim 6, wherein, at the input end of said device, the bottom wall of said second section is parallel with the top wall of said first section and is spaced apart therefrom by the height of the first and second parallel side walls of said first section thereat.

8. A device according to claim 7, wherein the distance between said input end and said output end of said device is on the order of at least two wavelengths of the frequency of the electromagnetic wave being coupled to the device.

9. For use in a $TE_{10}$ rectangular mode to $TE_{01}$ circular waveguide mode launcher, a device for converting a $TE_{10}$ rectangular mode wave to a $TE_{20}$ rectangular mode wave comprising:

a first open-ended waveguide section having a top wall and first and second vertically parallel tapered side walls tapering from an input end of said device for receiving a $TE_{10}$ rectangular mode wave to an output end of said device; and a second open-ended waveguide section having non-parallel top and bottom walls and first and second non-parallel tapered side walls defining and extending from a rectangular output end of said device to said input end of said first section such that the top and bottom walls of said second section effectively intersect one another at the input end of said first section for form a bottom wall of said first open-ended waveguide section thereby forming a rectangular input end of said device, whereby a $TE_{10}$ rectangular mode wave coupled to said input end of said device is converted to a $TE_{20}$ rectangular mode wave at the output end thereof.

10. A device according to claim 9, wherein, at the input end of said device, the bottom wall of said second section is parallel with the top wall of said first section and is spaced apart therefrom by the height of the first and second parallel side walls of said first section thereat.

11. A device according to claim 10, wherein the distance between said input end and said output end of said device is on the order of at least two wavelengths of the frequency of the electromagnetic wave being coupled to the device.

* * * * *